US007125349B2

(12) United States Patent
Tucker

(10) Patent No.: US 7,125,349 B2
(45) Date of Patent: Oct. 24, 2006

(54) SHOTGUN HIKER

(76) Inventor: Calvin Tucker, P.O. Box 1010, Shiner, TX (US) 77984

( * ) Notice: Subject to any disclaimer, the term of this patent is extended or adjusted under 35 U.S.C. 154(b) by 0 days.

(21) Appl. No.: 10/767,876

(22) Filed: Jan. 29, 2004

(65) Prior Publication Data

US 2005/0170917 A1 Aug. 4, 2005

(51) Int. Cl.
*A63B 69/00* (2006.01)

(52) U.S. Cl. ..... 473/438; 473/422

(58) Field of Classification Search ..... 473/431, 473/438, 417–420, 451, 422; 124/7, 8, 36, 124/21

See application file for complete search history.

(56) References Cited

U.S. PATENT DOCUMENTS 2,705,003 A * 3/1955 Schensted ..... 124/16
2,767,985 A * 10/1956 Maxcey, Jr. et al. ..... 473/438
2,861,141 A * 11/1958 De Brocke ..... 200/61.41
3,399,892 A * 9/1968 Jurkiewicz ..... 473/438
3,529,823 A * 9/1970 Garver ..... 473/418
3,700,238 A * 10/1972 Mathis ..... 473/438
4,460,173 A * 7/1984 Dumas ..... 473/419
4,511,141 A * 4/1985 Dumas ..... 473/419
4,648,596 A * 3/1987 Long ..... 473/419
4,906,001 A * 3/1990 Vaughn ..... 473/438
5,060,934 A * 10/1991 Winston ..... 482/49
5,613,678 A * 3/1997 McKee et al. ..... 473/397
D422,028 S * 3/2000 Warner ..... D21/720
6,050,906 A * 4/2000 Stout et al. ..... 473/438
6,093,119 A * 7/2000 Tipton ..... 473/438
6,099,417 A * 8/2000 Brown et al. ..... 473/417
6,375,584 B1 * 4/2002 Shapiro ..... 473/419
6,575,852 B1 * 6/2003 Orner ..... 473/438
6,718,961 B1 * 4/2004 Woods et al. ..... 124/7

* cited by examiner

*Primary Examiner*—Mitra Aryanpour
(74) *Attorney, Agent, or Firm*—Marcus Hammack

(57) ABSTRACT

The invention is of a Shotgun hiker, a mechanical football hiker that propels the football five yards in a consistent direction and manner in order to allow football teams to practice the shotgun offense without the use of a trained team member to hike the football.

3 Claims, 3 Drawing Sheets

SHOTGUN HIKER

BACKGROUND OF THE INVENTION

1. Field of the Invention

The present invention relates to mechanical football hikers.

2. Background Information

Football is a national passion, and where there are football games, there are football practices. Football practice seasons and football practice sessions are typically regulated by league rules in order to ensure consistency and fairness. These rules, for instance, may limit the amount of time a team can practice or limit the length of the practice season a team can require players to be present for practice.

Working within these constraints, consistency is difficult to maintain when propelling or hiking a football to the quarterback during practice sessions. This is true because the job of hiking the ball during practice typically falls to an "expendable" member of the team or training staff because the official ball hiker is most likely performing his own training. It would be inefficient to utilize a valuable member of the team to perform such a monotonous, repetitive function as hiking the ball to the practicing quarterback, when that team member could be furthering his own skills, especially when practice time is limited. Another variation of this problem is encountered during off season practice sessions when attendance is not required and therefore the presence of a hiker is optional. This has led to the development of mechanical ball hikers.

Currently, the mechanical ball hikers that are available merely "hand" the ball to the quarterback, and do not propel it in the manner required to simulate that required for the "shotgun" formation. Therefore, existing ball hikers may be adequate for teams using standard line-ups and plays, but are useless for those employing the "shotgun" offense, in which the quarterback typically stands back from the offensive line about five yards. This line-up is advantageous in certain situations because it gives the quarterback more time to throw the ball and is very hard to defend against. It is an advantageous offense to use with a light, quick front line and a quarterback who knows how to run as well as throw the ball. More and more high school and college teams are taking advantage of the unique plays that such a line-up favors.

The shotgun hiker of the present invention solves the problem of how to train a quarterback in the shotgun offense by creating the force needed to mechanically propel a football over a distance, consistently and in a predictable direction. This allows football team members to maximize their practice time and football coaches to most efficiently and effectively train quarterbacks and other team members in the shotgun offense.

SUMMARY OF THE INVENTION

In view of the foregoing, it is an object of the present invention to provide a mechanical means to propel or hike a football during football practice.

It is another object of the present invention to provide a more convenient method of practicing the shotgun offense by providing a mechanical means to propel or hike a football over a distance, rather than merely "hand the ball" to the quarterback during football practice.

It is a further object of the present invention to provide a consistent means of propelling or hiking the football over a distance into the hands of a quarterback during football practice without the use of an experienced team member.

In satisfaction of these and other related objectives, Applicant's present invention provides a convenient, consistent, mechanical means to propel a football over a distance into the hands of a practicing quarterback in order that the team may practice the shotgun offense without the use of an experienced team member to hike the ball.

Applicant's approach to the problem described above is certainly simple, but it is equally unobvious. Applicant's Shotgun Hiker makes possible, for the first time, a mechanical means of propelling or hiking a football over a distance, which allows a football team to practice the shotgun offense without the use of an experienced team member to hike the football.

DETAILED DESCRIPTION OF THE PREFERRED EMBODIMENT

Figure 1:
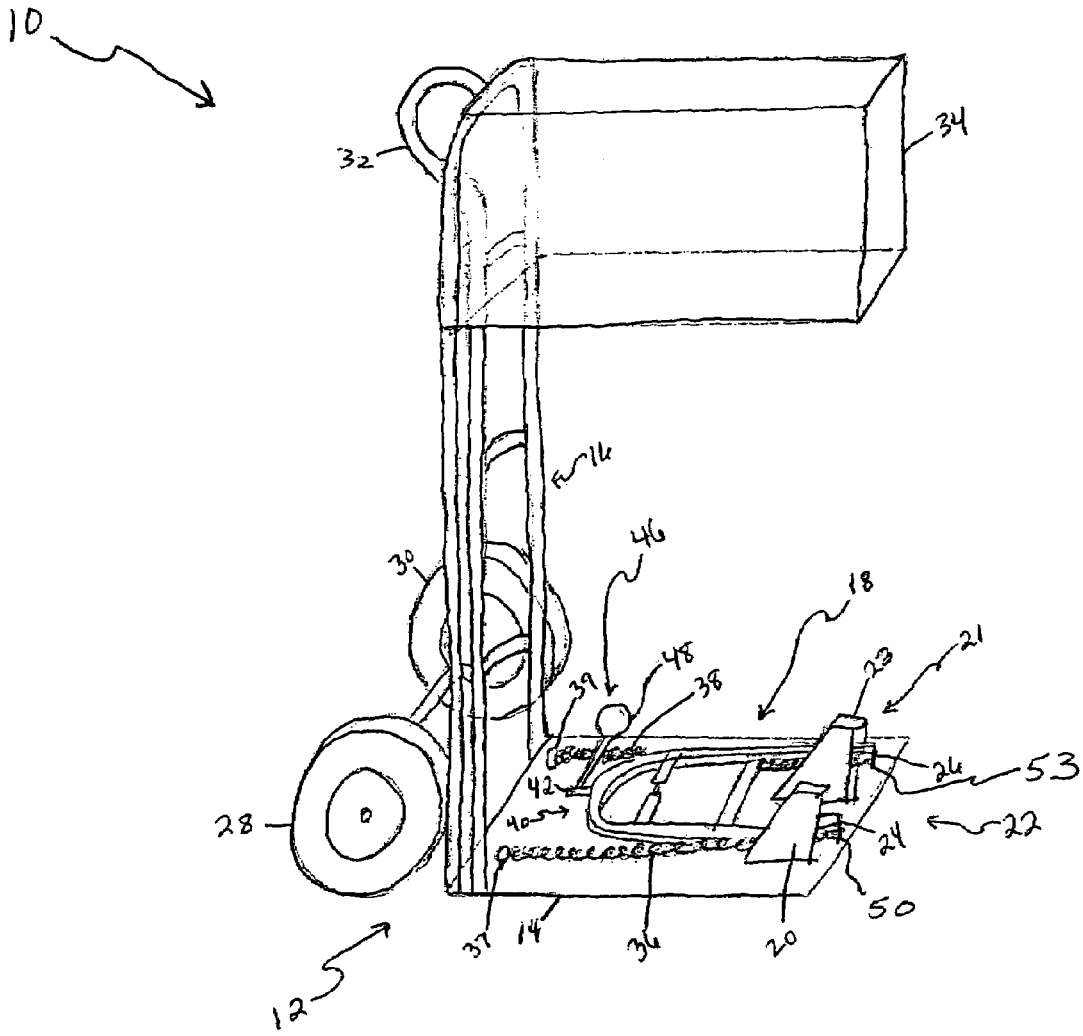
FIG. 1 is a perspective view of the Shotgun Hiker.

With reference to FIG. 1, the shotgun hiker of the present invention is identified generally by the reference number 10.

Shotgun hiker 10 of the preferred embodiment, as shown in FIG. 1, includes support frame 12. Support frame 12 includes base 14 and an upright structure 16 (attached to base 14 through the use of bolts or screws in a conventional manner). Upright structure 16 includes, in the preferred embodiment, two wheels 28 and 30 and a handle structure 32 which afford the hiker 10 with dolly-like portability.

In the embodiment shown, upright structure 16 also includes ball holder 34 which is attached through conventional means to upright structure 16 to allow for the convenient storage and transfer of extra footballs. Many configurations of a support frame 12 could be developed by one skilled in the pertinent art and the invention is not limited by the embodiment described here.

Figure 2:
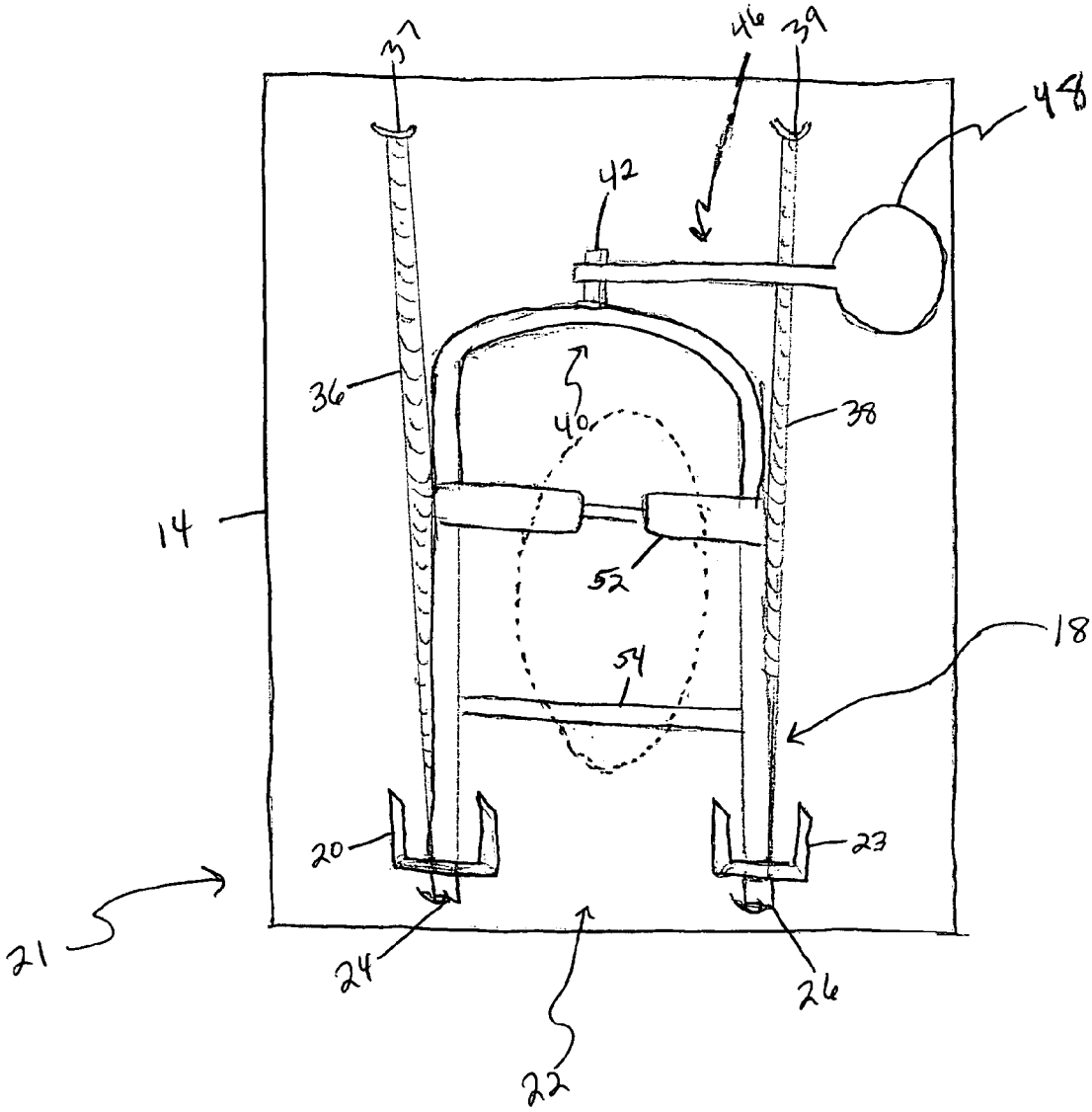
FIG. 2 is an enlarged top plan view of the ball-launching platform of the Shotgun Hiker.

Seen best in FIGS. 1 and 2, ball launching platform 18 is pivotally connected to pivot blocks 20 and 23 near, but not at, its proximal end 22 (which includes left proximal terminus 24 and right proximal terminus 26, respectively, on either side of proximal end 22 of ball launching platform 18).

Left and right proximal termini 24 and 26 are rotatably engaged with respective left and right pivot blocks 20 and 23 by the use of a conventional threaded axle and nut assemblies. Left and right springs 36 and 38 are attached to left and right proximal termini 24 and 26 further proximal to the pivot points of ball launching platform 18 vis a vis pivot blocks 20 and 23. In the arrangement depicted, it is clear that springs 36 and 38 bias ball launching platform 18 from a pre-launch orientation (as shown in FIG. 1) wherein ball launch platform 18 is substantially parallel with base 14 and substantially perpendicular to upright structure 16, toward an upright, post-launch orientation in which platform 18 is substantially parallel with upright structure 16. This attachment can be accomplished by hooking the respective ends of springs 36 and 38 through holes 50 and 53, not shown, in the respective proximal termini 24 and 26.

Figure 3:
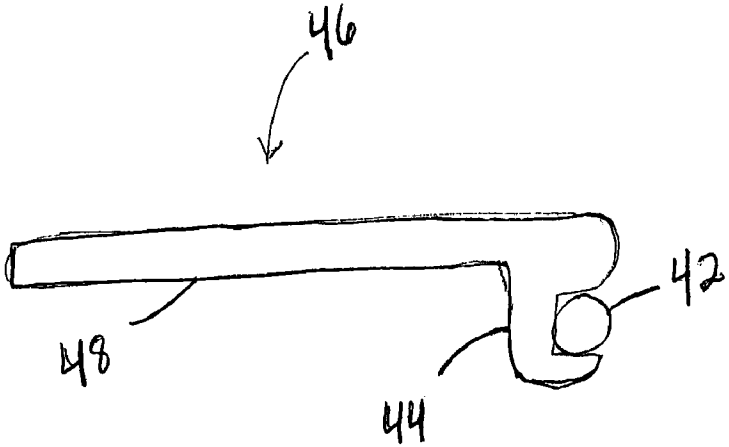
FIG. 3 is an enlarged cross-sectional view of the release actuation means of the Shotgun Hiker.

Referring in combination to FIGS. 1 and 3, ball launching platform 18 is held in its pre-launch orientation, against the forces of springs 36 and 38, through interaction of catch arm 42 (at the distal end 40 of platform 18) with release actuator assembly 46.

Release actuator assembly 46 is a trigger mechanism of generally conventional design, one generally instructive example of which may be seen in U.S. Pat. No. 4,539,968, the disclosure of which is incorporated here by reference. Slight variations in the trigger design for trigger mechanism 46 will follow like variations in trigger designs in general. Additional patents with such variations, the general trigger mechanism design of which could readily be applied to shotgun hiker 10, include U.S. Pat. Nos. 1,469,610; 3,490,429; and 6,478,020, the disclosures of which are here incorporated by reference.

Release actuation assembly 46 includes a trigger arm 48 which is pivotally mounted relative to base member 14. Sear arm 44 is configured and oriented for reversible engagement with catch arm 42 in conventional trigger fashion (see FIG. 3). When trigger arm 48 is activated, usually by stepping on it, trigger arm 48 moves pivotally downward, causing sear arm 44 to move pivotally upward, releasing catch arm 42, allowing ball launching platform 18 to pivot from its pre-launch orientation to its post-launch orientation under force of springs 36 and 38.

The preferred embodiment utilizes fourteen-inch springs from Century Spring Company, catalog number C-353, or its equivalent, to produce the force needed to propel a standard football five yards and at the proper height for a football quarterback in the shotgun offense. This result is achieved when launch platform 18 is approximately 20½ inches in length and pivots about a point 4½ inches from its proximal end. Springs 36 and 38 are attached substantially at their proximal ends as described above and, at their distal ends, are securely attached to base 14 at attachment points 37 and 39.

Figure 4:
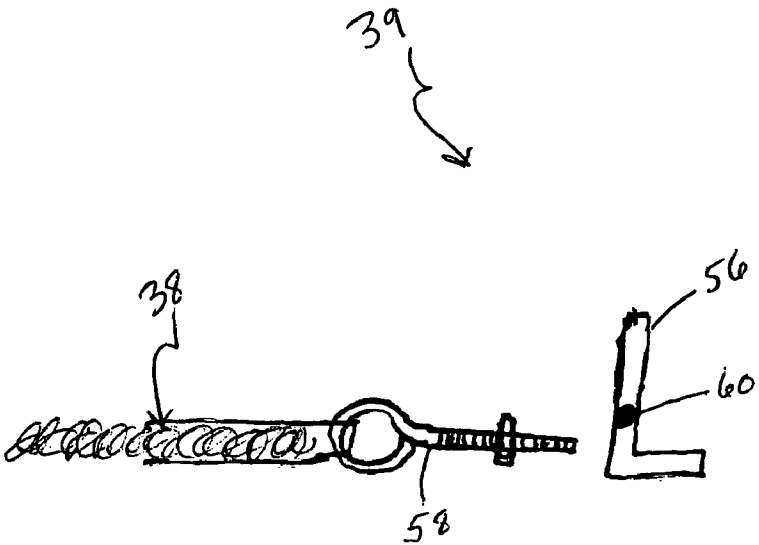
FIG. 4 is an enlarged cross-sectional view of the attachment point of the distal end of the springs.

The details of attachment point 39 are shown most clearly in FIG. 4. Referring to FIGS. 1 and 4, an L-shaped angle iron 56 is welded to base 14 in conventional manner ½ inch from the edge of base 14 closest to wheel 30. A 4-inch "I" bolt 58 is then attached to the distal end of spring 38 and screwed in through hole 60 drilled in the angle iron. The proper tension is achieved when "I" bolt 58 is screwed approximately 2 inches through the angle iron. An identical process attaches spring 36 at attachment point 37 and is not shown.

By selecting springs of varying gauges and varying lengths, the tensile strength of the springs can be varied and, therefore, the power with which the football is propelled can be controlled. Further, by varying the angle of the support frame 12, particularly base 14, the distance and height that the football is propelled can be controlled.

In practice, a football (shown in dotted lines in FIG. 2) is laid across ball rests 52 and 54 to await activation of release actuation assembly 46. Upon actuation of release actuation assembly 46, the football is propelled (in a direction away from the upright structure 16) to simulate the hiking of a football in the shotgun offense style (distant from the center).

In another embodiment, not shown in the drawings, a safety guard can be attached to the support frame 12 at the tubular handle structure 32 and the base 14 to shield users of the shotgun hiker from an errant football.

Most components of shotgun hiker 10 are expected to be assembled from steel, or other suitable hard material, with suitable plating or paint, to protect the material from the elements. The springs are those conventionally found and familiar to one skilled in the pertinent art.

Although the invention has been described with reference to specific embodiments, this description is not meant to be construed in a limited sense. Various modifications of the disclosed embodiments, as well as alternative embodiments of the inventions will become apparent to persons skilled in the art upon reference to the description of the invention. It is, therefore, contemplated that the appended claims will cover such modifications that fall within the scope of the invention.

I claim:

1. A football hiking apparatus comprising:

a mobile support frame, said mobile support frame having a horizontal member and a vertical member, said horizontal member having a proximal and a distal end, said vertical member having a proximal and a distal end, said horizontal member and said vertical member being rigidly attached perpendicular to one another at said horizontal member proximal end and said vertical member proximal end, said mobile support frame having wheels near the attachment of said horizontal member and said vertical member and a handle member attached at said distal end of said vertical member such that said apparatus may be transported in a dolly-like fashion;

first and second pivot blocks attached to said horizontal member of said mobile support frame near said horizontal member distal end;

a ball launching platform having a proximal end and a distal end, said ball launching platform being pivotally engaged with said first and second pivot blocks near said proximal end of said ball launching platform for pivotally moving said ball launching platform from a pre-launch orientation to a post-launch orientation, said ball launching platform being arranged such that the longitudinal axis of a football placed on said ball launching platform is substantially perpendicular to the pivot axis of said ball launching platform;

biasing means engaged with said proximal end of said ball launching platform for biasing said ball launching platform toward said post-launch orientation;

a catch arm attached to said ball launching platform at said ball launching platform distal end; and trigger release arm having a proximal end and a distal end, said trigger release arm being reversibly engageable with said catch arm at said trigger release arm proximal end, said trigger release arm being configured for actuation at said trigger release arm distal end via a foot pedal, said trigger release arm having a first and second position, wherein said trigger release arm retains said ball launch platform in said pre-launch orientation in said trigger release arm first position until said trigger release arm is actuated via said foot pedal to said trigger release arm second position releasing said ball launch platform for moving from said pre-launch orientation to said post-launch orientation under force of said biasing means such that said football is propelled through the air simulating a "shotgun" snap.

2. The apparatus of claim 1, wherein said biasing means comprising a plurality of interchangeable springs of respectively varying resistance.

3. The apparatus of claim 1 further comprising a ball holder, said ball holder attached to said vertical member of said mobile support frame near said distal end of said vertical member, said ball holder being configured for containing a plurality of footballs.

* * * * *